US010344460B2

(12) United States Patent
Karnegie

(10) Patent No.: US 10,344,460 B2
(45) Date of Patent: Jul. 9, 2019

(54) HAIR STRAINING DEVICE

(71) Applicant: JUKA INNOVATIONS CORPORATION, Farmingdale, NY (US)

(72) Inventor: Serge Karnegie, Glen Cove, NY (US)

( * ) Notice: Subject to any disclaimer, the term of this patent is extended or adjusted under 35 U.S.C. 154(b) by 0 days.

(21) Appl. No.: 14/990,476

(22) Filed: Jan. 7, 2016

(65) Prior Publication Data

US 2017/0073949 A1 Mar. 16, 2017

Related U.S. Application Data

(60) Provisional application No. 62/219,223, filed on Sep. 16, 2015.

(51) Int. Cl.
*E03C 1/264* (2006.01)

(52) U.S. Cl.
CPC ..... *E03C 1/264* (2013.01)

(58) Field of Classification Search
CPC ..... E03C 1/264
USPC ..... 4/291
See application file for complete search history.

(56) References Cited

U.S. PATENT DOCUMENTS

| | | | | |
|---|---|---|---|---|
| 394,213 | A | 12/1888 | Scannell | |
| 769,001 | A | 8/1904 | Lawrence | |
| 989,410 | A | 4/1911 | Peters | |
| 1,424,022 | A | 7/1922 | Lacoste | |
| 1,436,294 | A | 11/1922 | Scott | |
| 1,515,073 | A | 11/1924 | Savard | |
| 1,596,893 | A | 8/1926 | Schifter | |
| 1,612,588 | A | 12/1926 | Lacoste | |
| 1,770,639 | A | 7/1930 | West | |
| 1,903,366 | A * | 4/1933 | Mercier | E03C 1/264 4/292 |
| 2,038,852 | A | 4/1936 | Pasman | |
| 2,285,833 | A | 1/1938 | Platt | |
| 2,337,331 | A | 12/1943 | Kirschner | |
| 3,075,203 | A * | 1/1963 | Stafford | E03C 1/244 4/286 |
| D246,109 | S | 10/1977 | Rosaen | |
| 4,409,692 | A | 10/1983 | Ness | |
| 4,932,082 | A | 6/1990 | Ridgeway | |
| 5,201,340 | A | 4/1993 | Teepe | |
| 5,442,819 | A * | 8/1995 | Penor | E03C 1/26 4/288 |
| 6,263,518 | B1 * | 7/2001 | Magtanong | E03C 1/26 4/286 |
| 6,276,000 | B1 | 8/2001 | Saman | |

(Continued)

FOREIGN PATENT DOCUMENTS

| | | |
|---|---|---|
| CH | 228397 | 8/1943 |
| CN | 203498954 U * | 3/2014 |

(Continued)

OTHER PUBLICATIONS

CN 203498954 Translation.*
JP 2010059701 Translation.*

*Primary Examiner* — David P Angwin
*Assistant Examiner* — William R Klotz

(57) ABSTRACT

A straining device includes a top seal element, a central cylinder element and a bottom seal element and is positioned in a drain pipe of a shower, sink or bathtub to prevent hair from clogging the drain pipe while providing an aesthetically appealing appearance and allowing for easy cleaning.

3 Claims, 8 Drawing Sheets

(56) References Cited

U.S. PATENT DOCUMENTS

| | | | | |
|---|---|---|---|---|
| 6,308,350 | B1 | 10/2001 | Marchionda | |
| 6,387,261 | B1 | 5/2002 | Mojena | |
| D467,648 | S * | 12/2002 | Delva | D23/266 |
| 6,558,538 | B2 | 5/2003 | Scuilla | |
| 6,938,279 | B1 | 9/2005 | Henderson | |
| 7,150,576 | B1 * | 12/2006 | Kambeyanda | E03C 1/282 4/652 |
| 7,376,983 | B1 * | 5/2008 | Sciarrino | E03C 1/264 4/288 |
| 7,704,386 | B2 * | 4/2010 | Ventura | E03C 1/264 210/163 |
| 8,011,030 | B2 * | 9/2011 | Li | E03C 1/262 4/286 |
| D650,471 | S | 12/2011 | Du | |
| 8,316,474 | B2 | 11/2012 | Kang | |
| D691,244 | S | 10/2013 | Ho | |
| D691,245 | S | 10/2013 | Ho | |
| 9,038,204 | B2 | 5/2015 | Walsh | |
| D746,417 | S | 12/2015 | Guterman | |
| D749,706 | S | 2/2016 | Johansen | |
| D753,791 | S | 4/2016 | Ruprecht | |
| D756,483 | S | 5/2016 | Ruprecht | |
| 9,371,636 | B2 | 6/2016 | Ali | |
| 9,518,383 | B2 | 12/2016 | Lesmeister | |
| 2002/0139731 | A1 | 10/2002 | Michels | |
| 2004/0073992 | A1 | 4/2004 | Saman | |
| 2009/0007321 | A1 | 1/2009 | Kang | |
| 2012/0047643 | A1 * | 3/2012 | Meyers | E03C 1/264 4/292 |
| 2012/0060275 | A1 | 3/2012 | Cheng | |
| 2014/0007334 | A1 | 1/2014 | Golibart | |
| 2015/0259892 | A1 | 9/2015 | Gusterman | |
| 2015/0321127 | A1 | 11/2015 | Arent | |
| 2016/0130793 | A1 | 5/2016 | Lesmeister | |
| 2016/0251839 | A1 | 9/2016 | Ali | |

FOREIGN PATENT DOCUMENTS

| | | | | |
|---|---|---|---|---|
| CN | 203583605 | U | | 7/2014 |
| CN | 104790511 | A | | 7/2015 |
| DE | 625068 | C | | 2/1936 |
| DE | 20103271 | U1 | | 6/2001 |
| EP | 1600566 | A1 | | 11/2005 |
| EP | 2816161 | A1 | | 12/2014 |
| GB | 2478146 | B | | 8/2011 |
| JP | D1292683 | | * | 1/2007 |
| JP | D1292683 | | | 2/2007 |
| JP | 201059701 | A | | 3/2010 |
| JP | 2010059701 | A | * | 3/2010 |
| KR | 300524295.0000 | | | 3/2009 |
| KR | 101679787 | B1 | | 11/2016 |
| SU | 1747617 | A1 | | 7/1992 |
| WO | WO2006079141 | A1 | | 8/2006 |

* cited by examiner

BOTTOM FLANGE (22)

CYLINDER (16)

HAIR STRAINING DEVICE

CROSS-REFERENCE TO RELATED APPLICATIONS

The present application claims priority to and the benefit of U.S. Provisional Patent Application Ser. No. 62/219,223 filed Sep. 16, 2015 entitled HAIR STRAINING DEVICE, the entire content of which is hereby incorporated by reference herein.

BACKGROUND

Field of the Disclosure

The present invention relates to a straining device, preferably for use in a shower stall, sink or bathtub to prevent hair from entering and clogging the drain pipe.

Related Art

Drain pipes, particularly those that service shower stalls or bathtubs are often clogged by an accumulation of hair that is shed by users during the bathing process. The hair flows down the drain with the bathing water and accumulates in the drain pipe to form a clog that prevents proper drainage. Existing straining devices to catch this hair are typically provided above the drain pipe opening in the floor of the shower stall or bathtub in view of the user. Such devices are unsightly in that the accumulated hair is visible to the user at all times. These devices also have limited effectiveness and are difficult to clean.

Accordingly, it would be desirable to provide a straining device that avoids these and other problems.

SUMMARY

It is an object of the present invention to provide a straining device that may be inserted into a drain pipe in a shower stall, sink or bathtub or other similar structure to prevent hair from clogging the drain pipe and to keep the accumulated hair out of view of the user.

A straining device in accordance with an embodiment of the present application includes a central element with a hollow core surrounded by a sidewall, the sidewall including at least one opening formed therein; and a bottom seal element connected to a bottom end of the central element and extending radially outward, the bottom seal element including at least one bottom drain opening formed therein, the at least one opening and the at least one bottom opening sized and positioned to substantially prevent hair from flowing therethrough.

A straining device in accordance with another embodiment of the present application includes a cylindrical central element with a hollow core surrounded by a sidewall, the sidewall including at least one opening formed therein; and a bottom seal element connected to a bottom end of the cylindrical central element and extending radially outward, the bottom seal element including at least one bottom drain opening formed therein, the at least one opening and the at least one bottom opening sized and positioned to substantially prevent hair from flowing therethrough.

A method of preventing hair from clogging a drain pipe in accordance with an embodiment of the present application includes providing a straining device, the straining device including a central element with a hollow core surrounded by a sidewall, the sidewall including at least one opening formed therein; and a bottom seal element connected to a bottom end of the central element and extending radially outward, the bottom seal element including at least one bottom drain opening formed therein, the at least one opening and the at least one bottom opening sized and positioned to substantially prevent hair from flowing therethrough and inserting the straining device into the drain pipe such that at least the bottom seal element is received in the drain pipe and is positioned below a top edge thereof.

Other features and advantages of the present invention will become apparent from the following description of the invention which refers to the accompanying drawings.

DETAILED DESCRIPTION OF THE EMBODIMENTS

Figure 1:
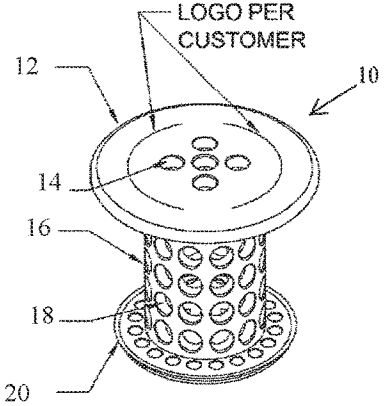
FIG. 1 illustrates a front and top perspective view of a straining device in accordance with an embodiment of the present disclosure.
Figure 2:
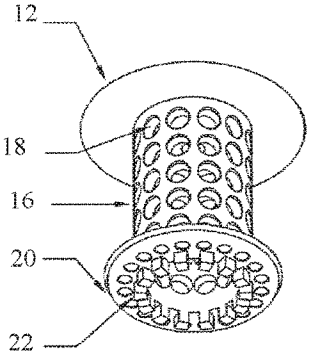
FIG. 2 illustrates a front and bottom perspective view of the straining device of FIG. 1.
Figure 3:
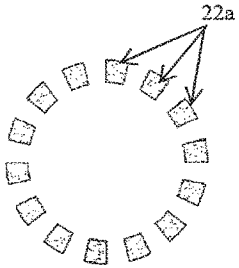
FIG. 3 is a more detailed view of a bottom flange of the straining device of FIG. 1.
Figure 4:
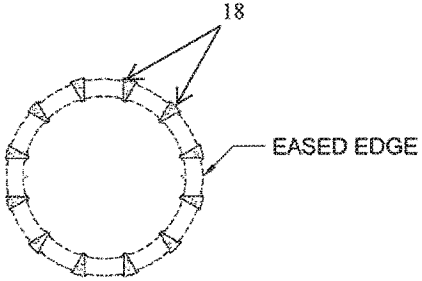
FIG. 4 is a horizontal cross-sectional view of a central element of the straining device of FIG. 1.

A perspective view of a straining device 10 in accordance with an embodiment of the present disclosure is illustrated in FIGS. 1-2, for example. The straining device 10 preferably includes a top seal element 12 mounted on a top of a central element, or central body, 16 with a bottom seal element 20 provided on the bottom end of the central element 16. The central element 16 is illustrated as having a cylindrical shape and is referred to herein interchangeable as the central element or the central cylinder, however, the central element 16 is not limited to a cylindrical shape. A flange 22, including protrusions 22*a*, preferably extends from the bottom of the central element 16 and outward from the bottom surface of the bottom seal element 20. The central element 16 includes a hollow central core through which water may pass, whether cylindrical in shape or any other desired shape. In a preferred embodiment, a plurality of center drain openings 18 are formed in the sidewall of the central element 16 to allow water to pass therethrough and into the hollow central core. While a plurality of drain openings 18 are preferred, the central element 16 need only include a single drain opening. A central portion of the top seal element 12 preferably includes a plurality of top drain openings 14 that extend therethrough to allow water to pass into the central core as well. While a plurality of top drain openings 14 are shown, a single top drain opening 14 may be used, or the top drain openings 14 may be eliminated altogether. The drain openings 14 and 18 allow water to pass into the hollow central core of the central element 16, however, are sized and positioned to impede the passage of hair into the hollow central core.

Figure 6:
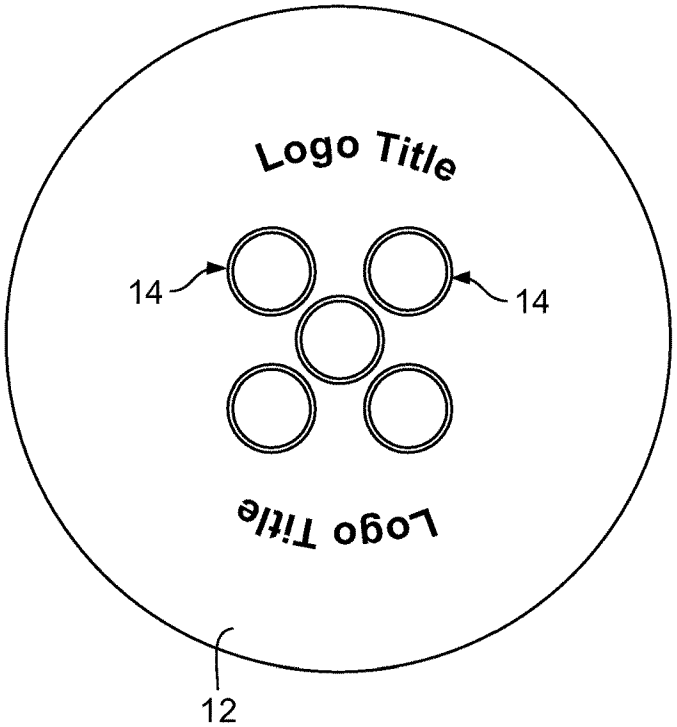
FIG. 6 is a more detailed view of a top seal element of the straining device of FIG. 1.
Figure 5:
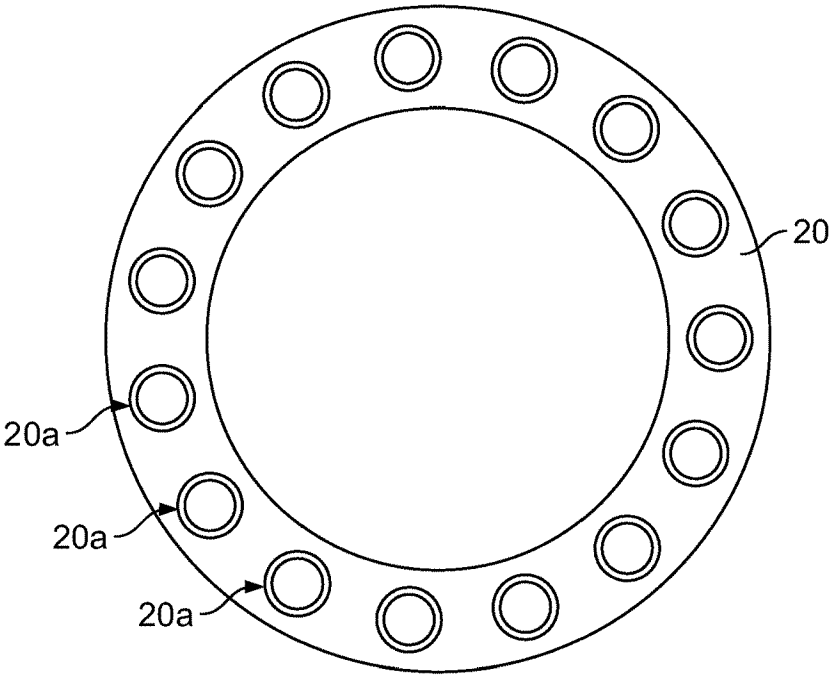
FIG. 5 is a more detailed view of a bottom seal element of the straining device of FIG. 1.
Figure 11:
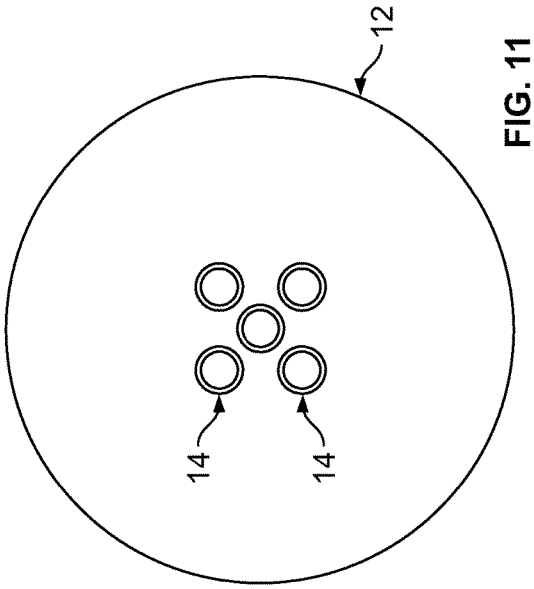
FIG. 11 is a more detailed view of the top seal element of the straining device of FIG. 1 indicating exemplary dimensions thereof.

The top seal element 12 is preferably substantially disk shaped (see FIGS. 6 and 11, for example) and is mounted on a top of the central cylinder 16. The top seal element 12 may be formed integrally with the central cylinder 16 (see FIG. 6, for example), or may be attached thereto, if desired. The bottom seal element 20 is preferably substantially ring shaped with the open center thereof aligned with the hollow central core of the central cylinder 16.

Figure 10:
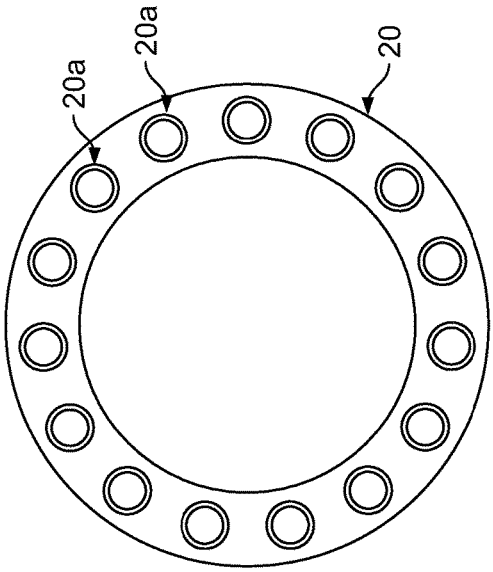
FIG. 10 is more detailed view of the bottom seal element of the straining device of FIG. 1 indicating exemplary dimensions thereof.
Figure 9:
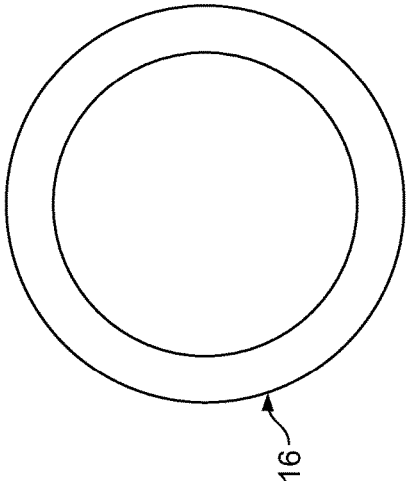
FIG. 9 is a horizontal cross-sectional view of the central element of the straining device of FIG. 1 illustrating an exemplary thickness of the sidewalls thereof.

The bottom seal element 20 preferably extends radially outward from the central cylinder 16 a predetermined distance and includes a plurality of bottom drain openings 20*a* formed therein. While it is preferred that a plurality of bottom drain openings 20*a* are provided, fewer or even a single bottom drain opening may be used, if desired. The bottom drain openings 20*a* preferably allow the flow of water therethrough, but are sized and positioned to prevent hair from passing therethrough. The diameter of the bottom seal element 20 is preferably less than that of the top seal element 12 and larger than that of the central cylinder 16. FIG. 10 illustrates exemplary dimensions of the bottom seal element 20, while FIG. 11 indicates exemplary dimensions of the top seal element 12. FIG. 9 illustrates an exemplary thickness of the sidewall of the central cylinder 16.

Figure 13:
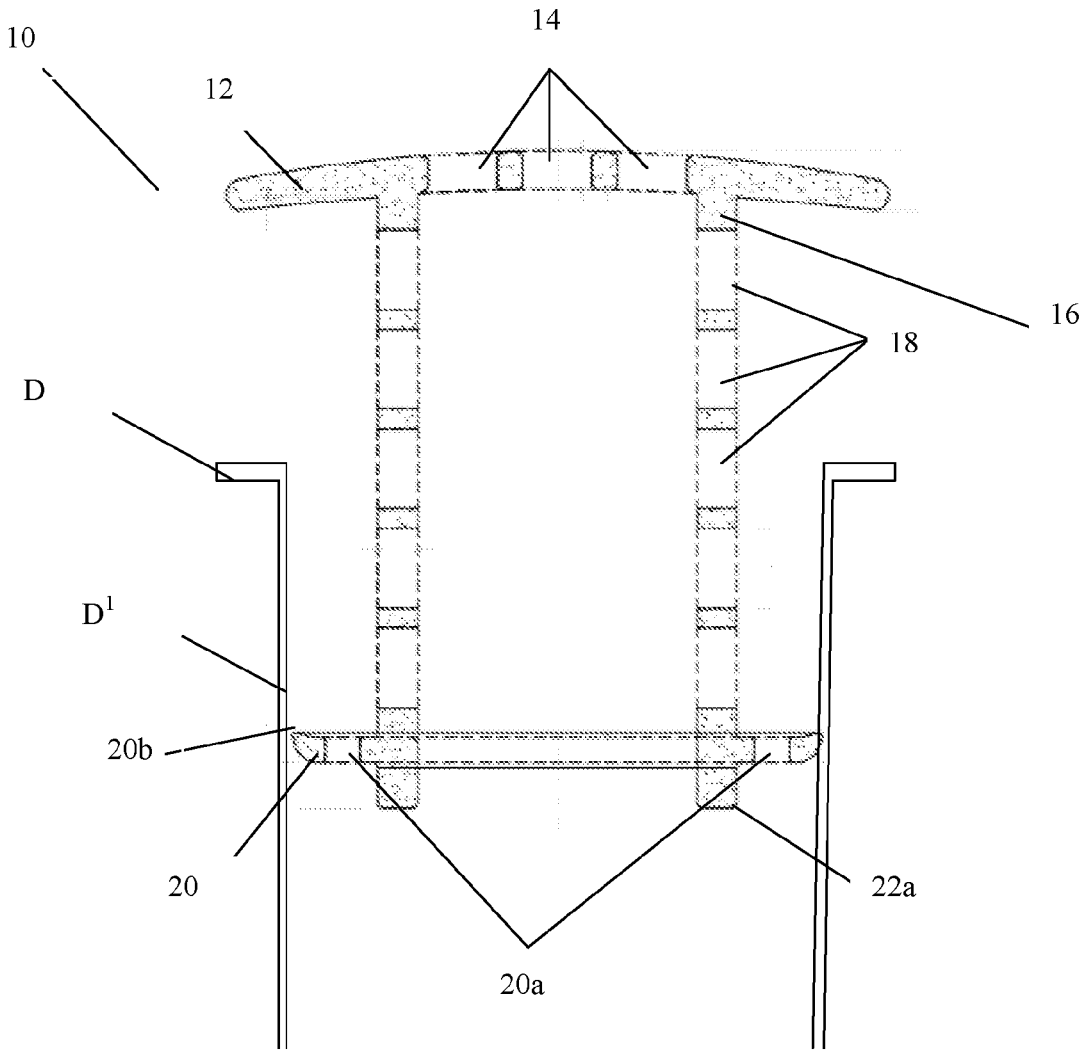
FIG. 13 is a vertical cross-sectional view of the straining device positioned in an exemplary drain pipe.

While the straining device 10 will most commonly be used in shower stalls or bathtubs, it is suitable for use in other drain pipes such as those used in sinks or other similar structures. FIG. 13 illustrates the straining device 10 positioned in an exemplary embodiment of a drain pipe D. Drain pipes in shower stalls and bathtubs generally have a standard diameter and the illustrated dimensions discussed above are appropriate for use in such standard drain pipes such that the diameter of the lower seal element 20 is substantially the same as the inner diameter of the drain pipe D and the outer edge of the lower seal element contacts an inner surface $D^1$ of the drain pipe to form a seal and prevent water from flowing around the outer edge. Accordingly, water can only drain into the drain pipe D through the center openings 18 and hollow core of the central cylinder 16 or the bottom openings 20*a* of the lower seal element 20, all of which are sized and spaced to prevent hair from passing therethrough. In the event that a water level exceeds the height of the top surface of the upper seal element 12, the top openings 14 are also sized and positioned to prevent the passage of hair therethrough, while allowing water to pass. In an embodiment, the center openings 18 may be 7/32 of an inch wide, the top openings 14 may be 1/8 inch wide and the bottom openings 20*a* may be 1/8 inch wide. While these dimensions are preferred, they may vary provided that the openings prevent hair from passing therethrough.

Drain pipes in sinks tend to be somewhat narrower than those in shower stalls or bathtubs and the straining device 10 may be dimensioned for use in sinks as well. That is, the dimensions of the straining device 10 may be modified as desired to be used with and inserted into different drain pipes.

Figure 8:
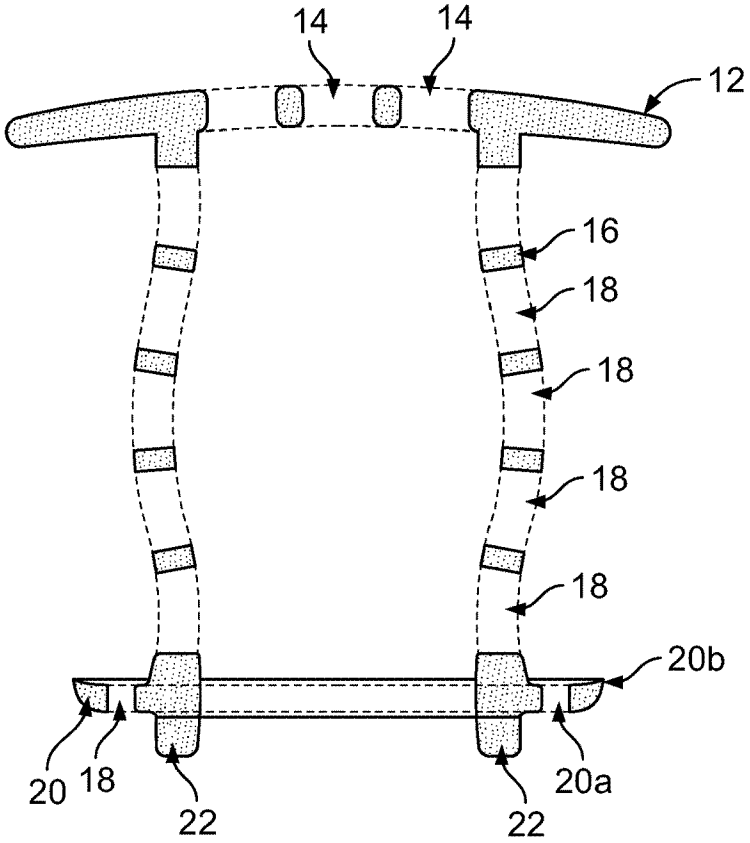
FIG. 8 is a vertical cross-sectional view of an alternative embodiment of the straining device of FIG. 1 in which the central element includes protruding sidewalls.
Figure 7:
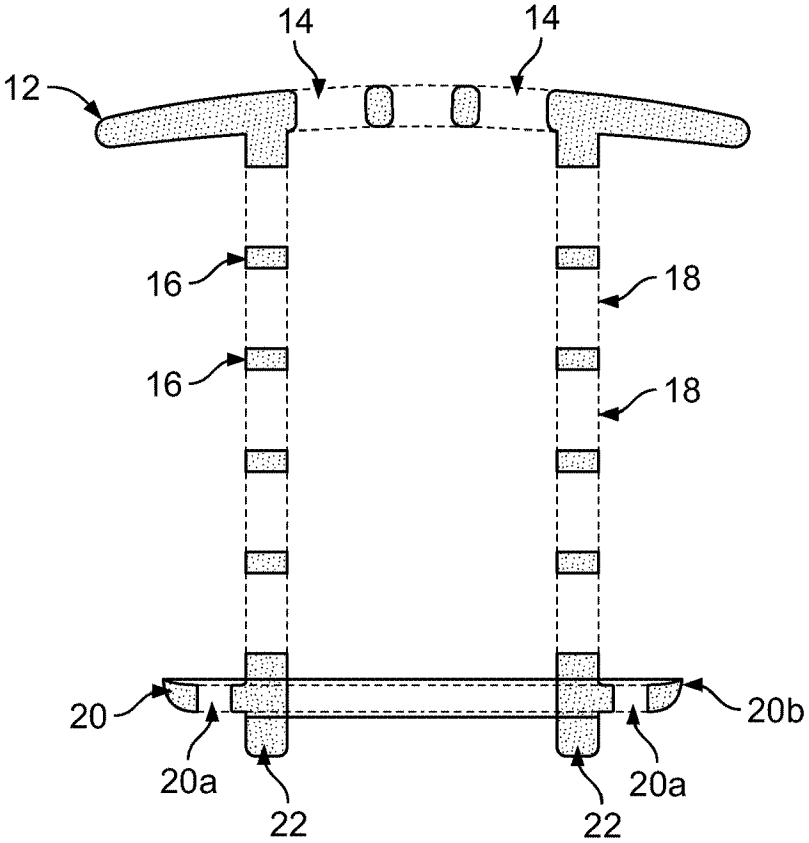
FIG. 7 is a vertical cross-sectional view of the straining device of FIG. 1.
Figure 8A:
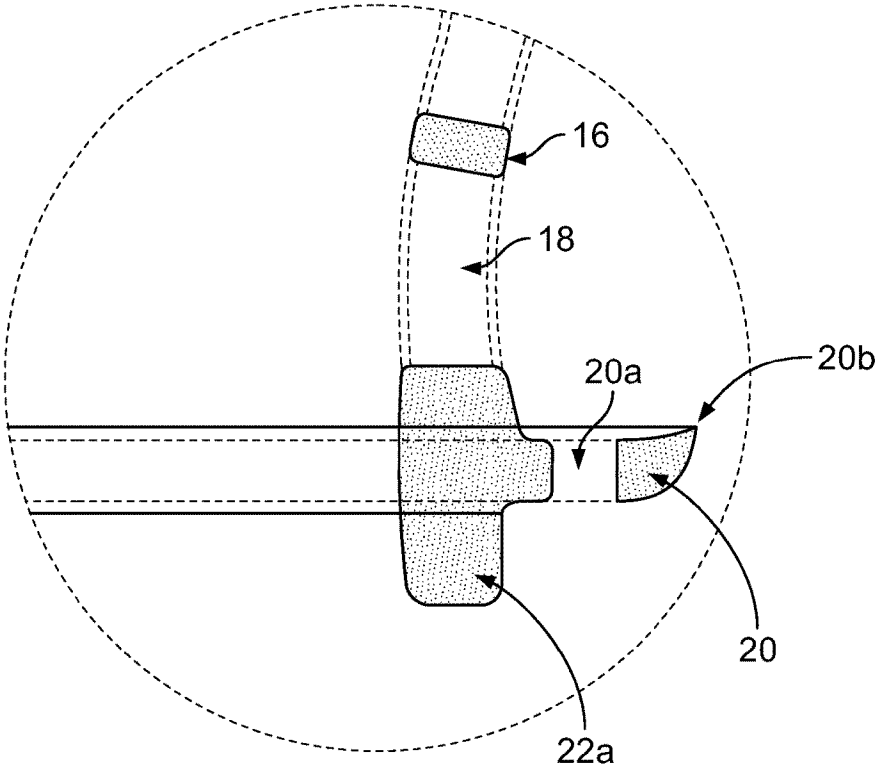
FIG. 8A is a more detailed view of a bottom, right portion of the cross-sectional view of FIG. 8.
Figure 12:
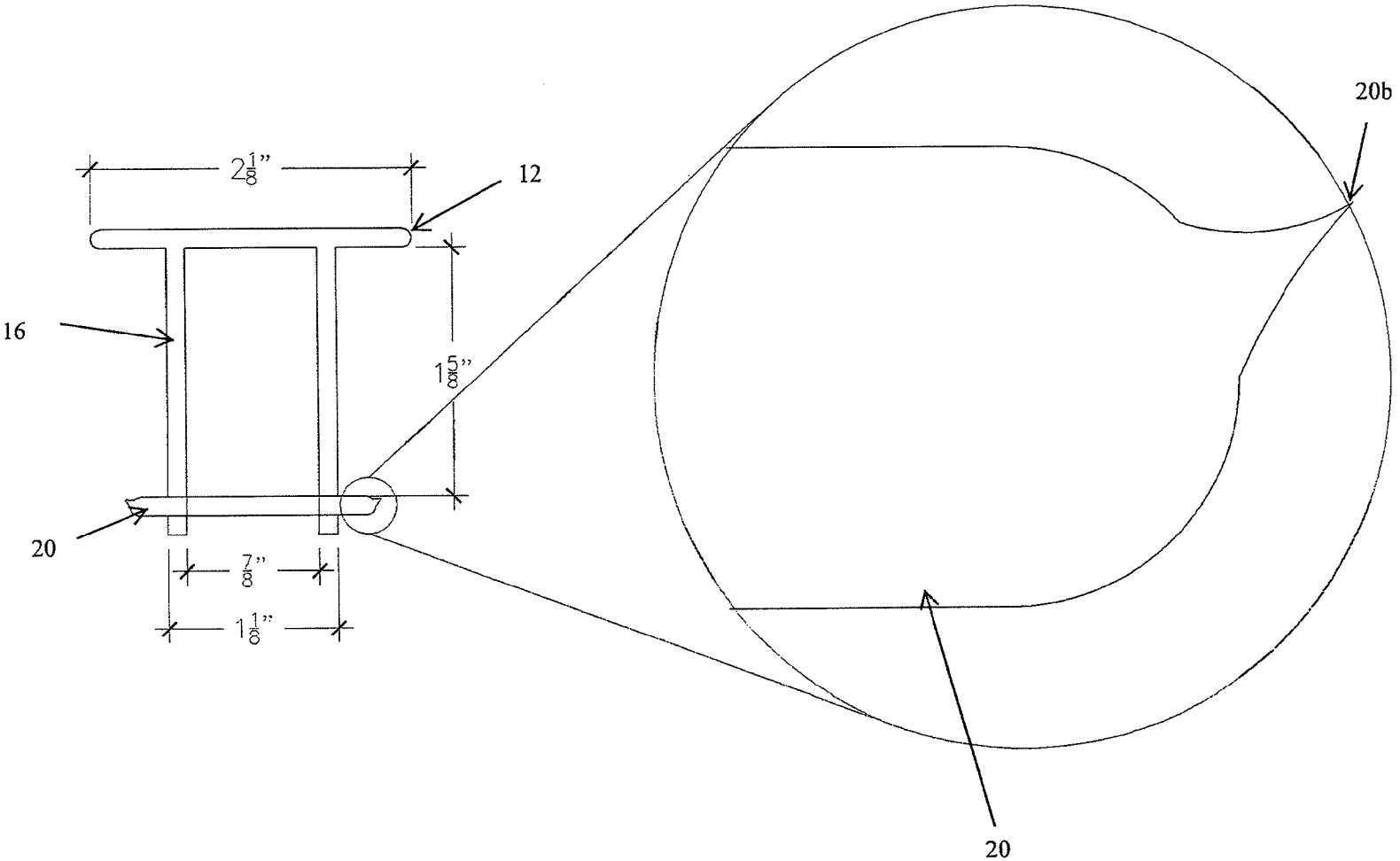
FIG. 12 is a vertical cross-sectional view of the straining device of FIG. 1 that does not bisect the central drain openings therein.
Figure 14:
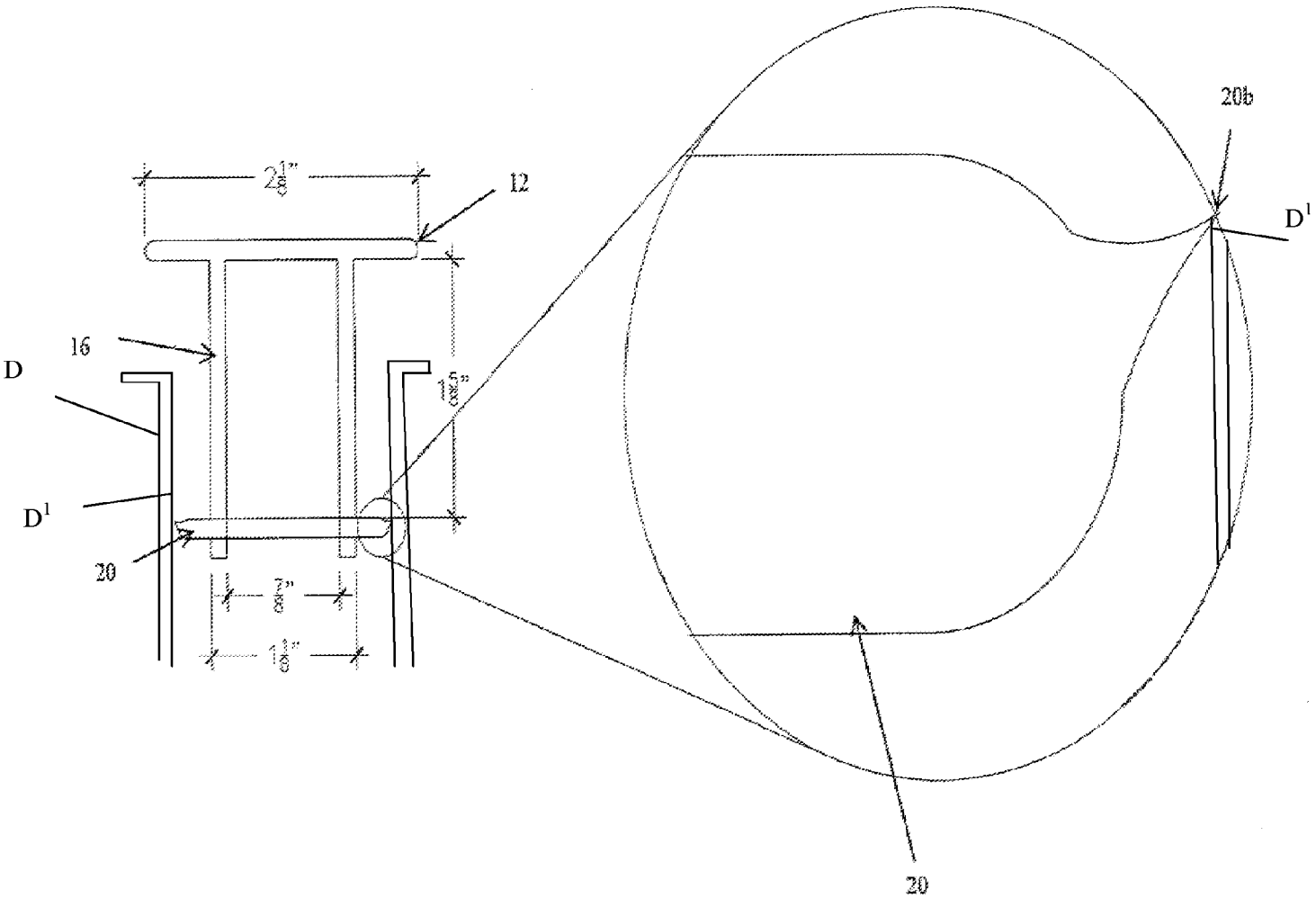
FIG. 14 is the cross-sectional view of the straining device positioned in the exemplary drain pipe of FIG. 13 including a more detailed view of the interaction of the lower seal element with the drain pipe.

As can be seen in FIG. 7, the central cylinder 16 may have substantially straight and parallel sidewalls. Alternatively, the central cylinder 16 may include protruding sidewalls as illustrated in FIG. 8. The bottom seal element 20 preferably includes a tapered sealing ridge 20*b* formed on the outer edge thereof. This tapered sealing ridge 20*b* preferably provides the seal between the inner drain pipe wall $D^1$ and the bottom seal element 20 when the straining device 10 is inserted into the drain pipe D, as illustrated in FIGS. 13-14, for example. The tapered seal ridge 20*b* prevents the flow of water around the bottom seal element 20 of the straining device 10. This ridge 20*b* is visible in more detail in FIGS. 12 and 14, for example.

In use, the straining device 10 is inserted into a drain pipe D. The bottom seal element 20 is sized to be received in the drain pipe D with the sealing ridge 20*b* in contact with the inner wall $D^1$ thereof to form a seal to prevent water from flowing around the bottom seal element 20. This forces water to pass through the bottom openings 20*a* in the bottom seal element 20, or the center drain openings 18 in the sidewall of the central element 16. The size and spacing of these openings prevents hair in the water from passing through the openings, particularly long hair. The tapered seal ridge 20*b* is preferably made of a somewhat resilient material to allow some flexing, as can be seen in FIG. 14, for example, on insertion into the drain pipe D to provide a tight seal. The top seal element 12 preferably has a diameter that is larger than that of the open end of the drain pipe D and the bottom seal element 20, as can be seen in FIGS. 13-14, for example.

In a preferred embodiment, the straining device 10 is inserted into the drain pipe D such that the top seal element 12 and an upper portion of the central cylinder 16 is visible above the drain pipe D, but the bottom seal element 20 and a lower portion of the central cylinder are inside the drain pipe D and not visible. This positioning is illustrated in FIGS. 13-14, for example. As water flows to the drain pipe D, it flows through the openings 18 and 20*a* in the central cylinder 16 and bottom seal element 20, respectively, and into the drain pipe D. As noted above, the size of and spacing between the openings 18, 20*a* prevents hair in the water from passing through these openings such that the hair accumulates on the top surface of the bottom seal element 20 and around the sidewalls of the lower part of the central cylinder 16, out of sight of a user. The shape of the central element 16 and the ring shape of the lower seal element 20 encourage the hair to wrap around the central element such that it can easily be removed when necessary. The straining device 10 is preferably made of a somewhat resilient material such as silicon or other rubber like material, however, is not limited to any specific material. The material of the straining device 10 may be colored to provide for a pleasing appearance, as desired. The straining device 10 may be inserted deeper into the drain pipe D than illustrated in FIGS. 13-14, if desired, and may be inserted deep enough that the top sealing element 12 cover the open end of the drain pipe D entirely. Further, the straining device 10 may be inserted less deep into the drain pipe D provided that at least the lower seal element 20 is positioned inside the drain pipe and out of view.

The straining device 10 of the present disclosure provides for excellent straining performance while ensuring that unsightly accumulations of hair remain out of sight of the user. In addition, since hair tends to wrap around the central cylinder 16 as it accumulates, removal of this hair from the straining device 10 is relatively quick and easy after the device is removed from the drain 10. Thus, the straining device 10 of the present application provides excellent straining functionality while providing an overall aesthetically pleasing appearance and easy cleaning.

Although the present invention has been described in relation to particular embodiments thereof, many other variations and modifications and other uses will become apparent to those skilled in the art.

What is claimed is:

1. A hair straining device comprising:

a central tube;

an upper wall;

a lower wall;

the central tube comprising a tube body, a top opening, a bottom opening, a plurality of side openings and a hollow core;

the top opening and the bottom opening each axially traversing through the tube body;

the top opening and the bottom opening being oppositely located to each other;

the plurality of side openings laterally traversing through the tube body;

the plurality of side openings being located in between the top opening and the bottom opening;

the hollow core being surrounded by the tube body;

the hollow core being in communication with the top opening, the bottom opening and the plurality of side openings;

the upper wall comprising an upper body and a plurality of upper openings;

the upper body being connected with the tube body;

the upper body being adjacently positioned to the top opening;

the plurality of upper openings axially traversing through the upper body;

the lower wall comprising a lower body, a lower opening, a plurality of lower holes, a ridge and a plurality of protrusions;

the lower body being connected with the tube body;

the lower body being adjacently positioned to the bottom opening;

the tube body being located in between the upper body and the lower body;

the lower opening axially traversing through the lower body;

the lower opening being in communication with the bottom opening;

the plurality of lower holes axially traversing through the lower body;

the plurality of lower holes being not in communication with the bottom opening;

the plurality of lower holes being peripherally distributed around the tube body;

the ridge being perimetrically formed on the lower body;

the ridge being tapered towards the upper body;

a radial diameter of the lower body being larger than a radial diameter of the tube body and smaller than a radial diameter of the upper body;

the tube body, the upper body, the lower body and the ridge each being made of a resilient material;

the plurality of protrusions being connected with the lower body;

the lower body being located in between the tube body and each of the plurality of protrusions;

the plurality of protrusions being peripherally distributed around the lower opening;

each of the plurality of protrusions axially extending away from the lower body;

a corresponding protrusion among the plurality of protrusions being located in between the lower opening and a corresponding lower hole among the plurality of lower holes; and the plurality of protrusions each being made of a resilient material.

2. The hair straining device of claim 1 comprising:

the top opening and the bottom opening being aligned with each other.

3. The hair straining device of claim 1 comprising:

the plurality of upper openings being in communication with the top opening.

* * * * *